United States Patent [19]

Nakaniwa et al.

[11] Patent Number: 4,957,083

[45] Date of Patent: Sep. 18, 1990

[54] FUEL SUPPLY CONTROL SYSTEM FOR INTERNAL COMBUSTION ENGINE WITH FEATURE PROVIDING ENGINE STABILITY IN LOW ENGINE LOAD CONDITION

[75] Inventors: Shinpei Nakaniwa; Naoki Tomisawa, both of Gunma, Japan

[73] Assignee: Japan Electronic Control Systems Company, Limited, Isezaki, Japan

[21] Appl. No.: 253,532

[22] Filed: Oct. 5, 1988

[30] Foreign Application Priority Data

Oct. 12, 1987 [JP] Japan ..... 62-254678

[51] Int. Cl.[5] ..... F02D 41/04

[52] U.S. Cl. ..... 123/436; 123/480

[58] Field of Search ..... 123/436, 478, 480, 486

[56] References Cited

U.S. PATENT DOCUMENTS

| | | | |
|---|---|---|---|
| 4,155,332 | 5/1979 | Yaegashi et al. | 123/478 |
| 4,604,703 | 8/1986 | Hasegawa | 123/480 |
| 4,637,362 | 1/1987 | Yasuoka et al. | 123/478 |
| 4,664,090 | 5/1987 | Kabasin | 123/478 |

FOREIGN PATENT DOCUMENTS

| | | |
|---|---|---|
| 57-68544 | 4/1982 | Japan . |
| 60-128947 | 8/1985 | Japan . |
| 60-203832 | 10/1985 | Japan . |

*Primary Examiner*—Andrew M. Dolinar

*Attorney, Agent, or Firm*—Foley & Lardner, Schwartz, Jeffery, Schwaab, Mack, Blumenthal & Evans

[57] ABSTRACT

A fuel supply control system introducing the feature of learning in assuming or projecting an intake air flow rate while an engine driving condition is maintained in a sonic flow range, in which intake air path area is maintained substantially constant and intake air flow rate is varied linearly according to variation of an engine speed. The system also detects the engine driving condition in the sonic flow range and the engine speed maintained substantially constant to derive a basic fuel supply amount on the basis of boost pressure. The assumed intake air flow rate is derived on the basis of the basic fuel supply amount and the engine speed. The system derives the basic fuel supply amount on the basis of the assumed intake air flow rate and the engine speed when the engine speed varies within the sonic flow range.

13 Claims, 10 Drawing Sheets

ROM
TD
DB
NVO
KTA
PBD
KFLAT
KALT
CPC
FL FEEDBACK
FL LEAN
FL RICH
FL INV
FL ABNORMAL
FLACC
TACC
FALT
FL EV
FLTRS
FLUP
ALT
C
T
RAM
TVO
KλRN
KLRN
ALTo
I
INTERFACE
A/D
N
Ti
Ta
TVO
SIDL
VPB
Tw
O2
θ ref
θ pos
VSP
NT
SCINJ
SC IDL
INTAKE AIR TEMP.
THROTTLE ANGLE
IDLING
INTAKE AIR PRES.
COOLANT TEMP.
O2
CRANK ANGLE
VEHICLE SPEED
NEUTRAL
INJECTION
IDLING SPEED

FUEL SUPPLY CONTROL SYSTEM FOR INTERNAL COMBUSTION ENGINE WITH FEATURE PROVIDING ENGINE STABILITY IN LOW ENGINE LOAD CONDITION

BACKGROUND OF THE INVENTION

1. Field of the Invention

The present invention relates generally to a fuel supply control system for an internal combustion engine. More specifically, the invention relates to a fuel supply control system which provides satisfactory engine stability at a low engine load condition, such as an engine idling condition.

2. Description of the Background art

In the modern automotive internal; combustion engine, the amount of fuel supply is precisely controlled according to engine driving conditions. Generally, fuel supply amount is determined on the basis of an engine revolution speed and an engine load condition. Intake airflow is used as a typical engine load condition representative parameter. As is well known, one of typical processes, such as that in D-Jetronics type fuel injection control system, a basic fuel supply amount is generally derived on the basis of the engine speed and the intake air flow rate. Though such type of fuel supply control is popular in the modern automotive internal combustion engine, sensors for monitoring the intake air flow rate as the engine load condition are relatively expensive.

For facilitating cheaper fuel supply control, intake air pressure (boost pressure) is used as an engine load representative parameter in certain fuel supply control systems, such as D-Jetronics type fuel injection control. Since pressure sensors for monitoring boost pressure in an air induction system is relatively cheap in comparison with the intake air flow rate sensors. In such a fuel supply control system, basic fuel supply amount is derived generally based on the boost pressure. The basic fuel supply amount is corrected by a correction value derived on the basis of correction factors including an engine speed.

In D-Jetronics type fuel injection control, boost pressure in the air induction system is varied with a certain lag relative to variation of the engine speed. This lag may affect the precision of fuel delivery. Basically, the degree of influence to precision is approximately proportional to the fluctuation rate (new engine speed/old engine speed) of the engine speed. Since the fluctuation rate is maintained substantially small at relatively high engine speed condition, influence to precision in control of fuel supply control is relatively small and cannot raise serious problems. However, on the other hand, at the low engine speed condition, the fluctuation rate of the engine speed becomes substantial to cause degradation in precision of fuel supply amount control. This tends to cause an unstability of engine, increasing possibility of engine stalling. Particularly, possibility of causing engine stalling becomes high while the engine is coasting at neutral gear condition due to falling air/fuel ration to a too lean condition.

In order to prevent the engine from stalling, Japanese Patent First (unexamined) Publication (Tokkai) Showa 57-68544 proposes fuel supply control in an engine idling condition, in which engine speed difference is differentiated to adjust the fuel supply amount on the basis of the differentiated value. In addition, spark advance is adjusted on the basis of the differentiated value. On the other hand, Japanese Patent First (unexamined) Publications (Tokkai) Showa 60-203832 and 60-128947 proposes adjustment of the fuel supply amount on the basis of engine speed difference or engine speed difference and variation magnitude of boost pressure.

Such prior proposed fuel supply control systems require substantially complex arithmetic operations. Furthermore, the precision level or response characteristics in air/fuel ratio control cannot be satisfactory.

SUMMARY OF THE INVENTION

Therefore, it is an object of the present invention to provide a fuel supply control system which can provide satisfactorily high engine stability even at low engine speed condition with high precision in air/fuel ratio control.

In order to accomplish the aforementioned and other objects, a fuel supply control system, according to the present invention, introducing the feature of learning in assuming or projecting an intake air flow rate while an engine driving condition is maintained in a sonic flow range, in which the intake air path area is maintained substantially constant and intake air flow rate is varies linearly according to variation of an engine speed. The system also detects the engine driving condition in the sonic flow range and the engine speed maintained substantially constant to derive a basic fuel supply amount on the basis of boost pressure. The assumed intake air flow rate is derived on the basis of the basic fuel supply amount and the engine speed. The system derives the basic fuel supply amount on the basis of the assumed intake air flow rate and the engine speed when the engine speed varies within the sonic flow range.

According to one aspect of the invention, a fuel supply control system for controlling amount of fuel to be delivered to an internal combustion engine, comprising:

a sensor means for monitoring preselected engine driving condition indicative parameters including an intake air pressure and an engine speed;

a first detector means for detecting a predetermined stable engine driving condition at an engine load condition lower than a predetermined value to produce a first detector signal;

a second detector means for detecting an engine speed variation rate to produce a second detector signal when the engine speed variation rate is smaller than a predetermined value;

a first arithmetic means for deriving a basic fuel supply amount on the basis of the intake air pressure;

a second arithmetic means for projecting an intake air flow rate data on the basis of the engine speed and the basic fuel supply amount under the presence of the first and second detector signals;

a third arithmetic means for deriving a basic fuel supply amount on the basis of the engine speed and the projected intake air flow rate data only under the presence of the first detector signal and the absence of the second detector signals; and a controlling means for deriving a fuel supply control signal based on the basic fuel supply amount for controlling fuel supply for the engine.

Preferably, the fuel supply control system further comprises a fourth arithmetic means for deriving an engine speed data on the basis of the monitored engine speed, the engine speed data deriving means operating in a first mode for updating the engine speed data with an instantaneous engine speed and in a second mode for updating the engine speed data with an average value which is derived an dynamic average value of previously derived engine speed data and the instantaneous engine speed, the fourth o arithmetic means operates in the first mode in response to the first detector signal, and the third arithmetic means derives the basic fuel supply amount on the basis of the engine speed data and the projected intake air flow rate.

The first detector means may detect an intake air pressure lower than or equal to a predetermined pressure and an intake air flow path area variation rate smaller than a given air flow path variation threshold. In practical arrangement, the first detector means is set when the given air flow rate variation threshold is zero. Similarly, the second detector means may be set when the predetermined value is zero.

The fuel supply control system further comprises a timer means responsive to the leading edge of the first detector signal for measuring an elapsed period of time to produce a timer signal when the measured period reaches a given period, and the third arithmetic means is responsive to the timer signal under absence of the second detector signal to derive the basic fuel supply amount.

According to another aspect of the invention, a fuel supply control system for an internal combustion engine comprising:

first means for supplying a controlled amount of fuel to an induction system of the internal combustion engine;

second means for monitoring an engine driving condition including an engine speed and an intake air pressure;

third means for detecting a predetermined low engine load condition to produce a detector signal;

fourth means for deriving an engine driving stability factor indicative value on the basis of preselected engine driving stability parameter;

fifth means for deriving a first basic fuel supply amount on the basis of the intake air pressure;

sixth means for projecting at intake air flow rate data on the basis of the first basic fuel supply amount and the engine speed;

seventh means for deriving a second basic fuel supply amount on the basis of the engine speed and the projected intake air flow rate;

eighth means for selectively operating one of the fifth and seventh means, the eighth means being responsive to the detector signal and the engine driving stability factor indicative value smaller than a predetermined value for operating the fifth means and otherwise operating the seventh means; and ninth means for producing a fuel supply control signal on the basis of one of the first and second basic fuel supply amount for controlling operation of the first means.

The fifth means may derive a basic volumetric efficiency on the basis of the intake air pressure and derives the basic fuel supply amount on the basis of the intake air pressure and the basic volumetric efficiency.

The second means may additionally monitor a throttle angular position, and the fourth means derives an intake air flow path area and variation rate of the intake air flow path area as a transistion representative first stability factor data on the basis of the throttle angular position. The fourth means further derives an engine speed variation rate as a second stability factor data, and the eighth means operates the fifth means when the engine speed variation rate is smaller than a predetermined value.

The fuel supply control system further comprises tenth means for deriving an average engine speed data and the eighth means controlling operation of the tenth means for setting instantaneous engine speed as the average engine speed data when the air flow path area variation rate is greater than a predetermined value and for deriving the average engine speed data on the basis of the instantaneous engine speed and the average engine speed data derived in the immediately preceding operation cycle when the air flow path area variation rate is smaller than or equal to the predetermined value. The second means may further monitor an engine idling speed control parameter, the system further comprises an eleventh means for deriving an engine idling control signal, and the fourth means derives the air flow path area variation rate on the basis of the throttle valve angular position and the engine idling control signal value.

The third means sets the predetermined low engine load condition at a sonic flow range.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
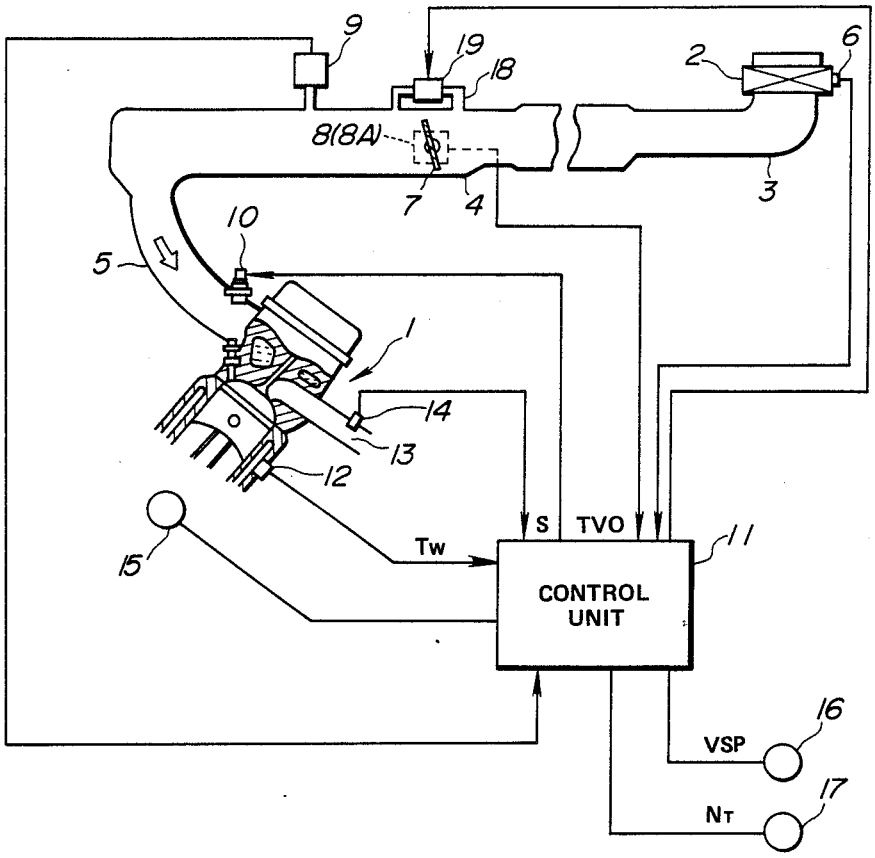
FIG. 1 is a schematic diagram showing the preferred embodiment of a fuel supply control system according to the present invention.
Figure 2:
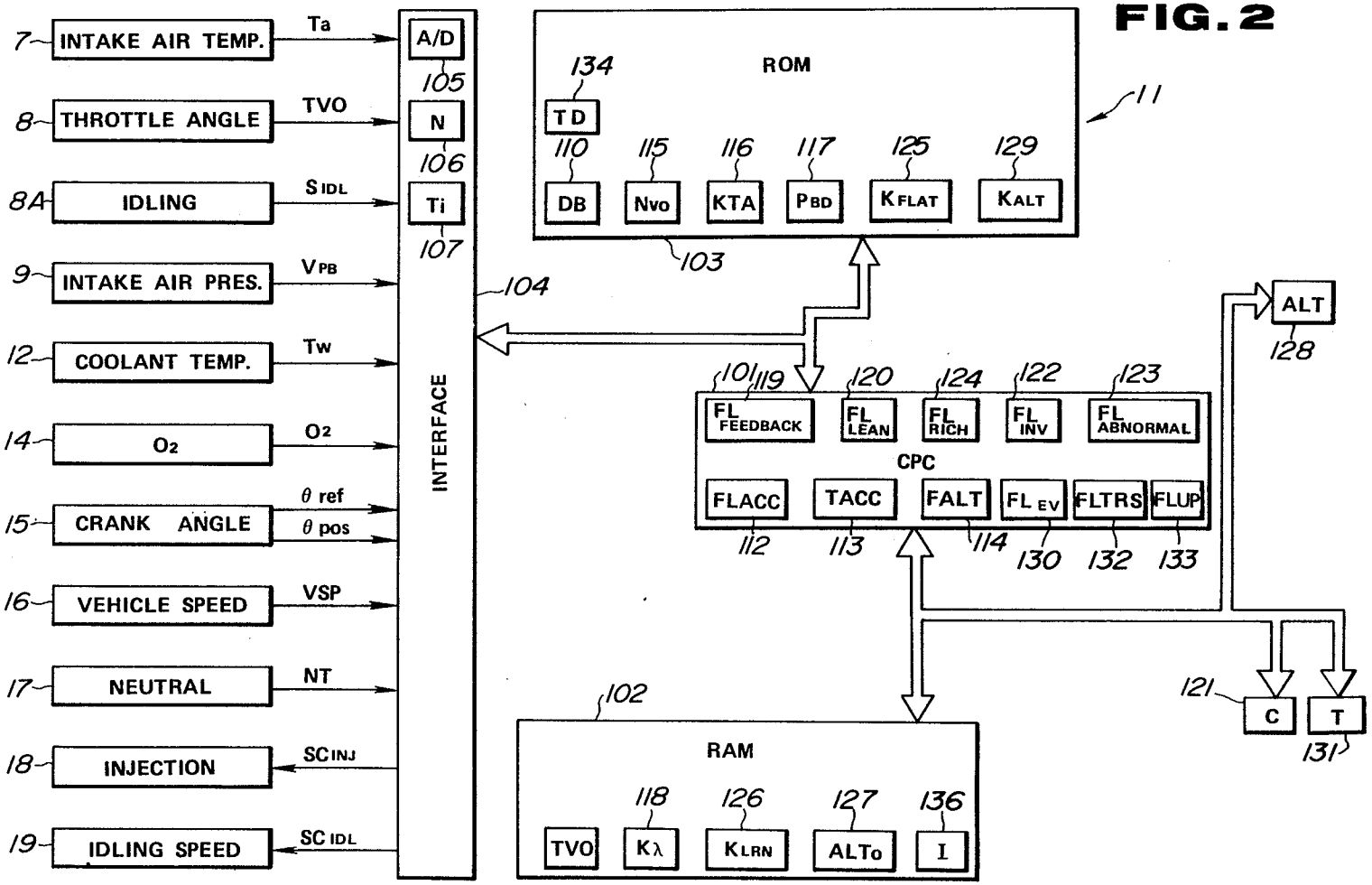
FIG. 2 is a block diagram showing details a control unit of the preferred embodiment of the fuel supply control system of FIG. 1.

Referring now to the drawings. particularly to FIG. 1, the preferred embodiment of a fuel supply control system, according to the present invention will be discussed in terms of fuel supply control for a fuel injection internal combustion engine. The fuel injection internal combustion engine 1 has an air induction system including an air cleaner 2, an induction tube 3, a throttle chamber 4 and intake manifold 5. An intake air temperature sensor 6 is provided in the air cleaner 2 for monitoring temperature of an intake air to produce an intake air temperature indicative signal.

A throttle valve 7 is pivotally disposed within the throttle chamber 4 to adjust an intake air path area according to depression magnitude of an accelerator pedal (not shown). A throttle angle sensor 8 is associated with the throttle valve 7 to monitor the throttle valve angular position to produce a throttle angle indicative signal TVO. The throttle angle sensor 8 incorporates an idling switch 8A which is designed to detect the throttle valve angular position in its substantially closed position. In practice, the idling switch 8A is held OFF while throttle valve open angle is greater than a predetermined engine idling criterion and ON while the throttle valve open angle is smaller than or equal to the engine idling criterion. An intake air pressure sensor 9 is provided in the induction tube 3 downstream of the throttle valve 7 for monitoring the pressure of the intake air flow through the throttle valve 7 for producing an intake air pressure indicative signal.

In the embodiment shown, a plurality of fuel injection valves (only one is shown) 10 are provided in respective branch paths in the intake manifold 5 for injecting the controlled amount of fuel for respectively associated engine cylinder. Each fuel injection valve 10 is connected to a control unit 11 which comprises a microprocessor. The control unit 11 feeds a fuel injection pulse for each fuel injection valve 10 at a controlled timing in synchronism with the engine revolution cycle to perform fuel injection.

The control unit 11 is also connected to an engine coolant temperature sensor 12 which is inserted into an engine coolant chamber of an engine block to monitor temperature of the engine coolant and produces an engine coolant temperature indicative signal Tw. The control unit 11 is further connected to an oxygen sensor 14 disposed within an exhaust passage 13 of the engine. The oxygen sensor 14 monitors oxygen concentration contained in an exhaust gas flowing through the exhaust passage 13 to produce an oxygen concentration indicative signal. The control unit is additionally connected to a crank angle sensor 15, a vehicle speed sensor 16 and a transmission neutral switch 17. The crank angle sensor 15 monitors the angular position of a crank shaft and thus monitors the angular position of an engine revolution cycle to produce a crank reference signal $\theta_{ref}$ at every predetermined angular position, e.g. at every crankshaft angular position 70° before top-dead center (BTDC), and a crank position signal at every predetermined angle, e.g. 1° of engine revolution. The transmission neutral switch 17 detects setting of a neutral position of a power transmission (not shown) to output transmission neutral position indicative HIGH level signal $N_T$.

Furthermore, the control unit 11 receives the intake air temperature indicative signal from the intake air temperature sensor 6 and throttle angular position indicative signal of the throttle angle sensor 8, the idling switch 8A and the intake air pressure sensor 9.

In the embodiment shown, an auxiliary air passage 18 is provided in the air induction system and by-passes the throttle valve 7 for supplying auxiliary air. An idling speed adjusting auxiliary air flow control valve 19 is provided in the auxiliary air passage 18. The auxiliary air flow control valve 19 is further connected to the control unit 11 to receive an idling speed control signal which is a pulse train having ON periods and OFF periods variable depending upon the engine driving condition for adjusting the duty ratio of the open period of the auxiliary air control valve 11. Therefore, by the idling speed control signal, the engine revolution speed during idling can be controlled.

Generally, the control unit 11 comprises CPU 101, RAM 102, ROM 103 and input/output interface 104. The input/output interface 104 has an analog-to-digital (A/D) converter 105, an engine speed counter 106 and a fuel injection signal output circuit 107. The A/D converter 105 is provided for converting analog form input signals such as the intake air temperature indicative signal Ta from the intake air temperature sensor 6, the engine coolant temperature indicative signal Tw of the engine coolant temperature sensor 12, the oxygen concentration indicative signal $O_2$, a vehicle speed indicative signal VSP of the vehicle speed sensor 16 and so forth. The engine speed counter 106 counts clock pulse for measuring the interval of occurrences of the crank reference signal $\theta_{ref}$ to derive an engine speed data N on the basis of the reciprocal of the measured period. The fuel injection signal output circuit 107 includes a temporary register to which a fuel injection pulse width for respective fuel injection valve 10 is set and outputs drive signal for the fuel injection signal at a controlled timing which is derived on the basis of the set fuel injection pulse width and predetermined intake valve open timing.

Details of the construction of the control unit will be discussed from time to time with the preferred process of the fuel injection control to be executed by the control unit, which process will be discussed herebelow with reference to FIGS. 3 to 13.

Figure 3:
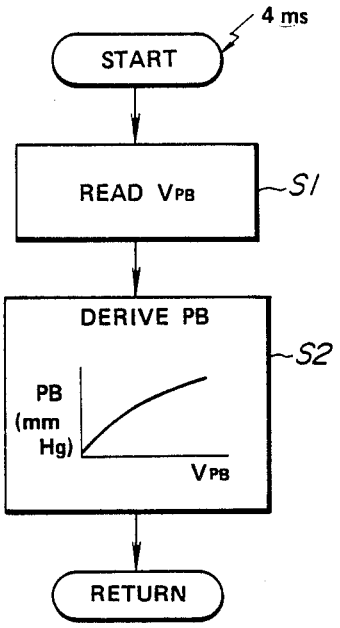
FIG. 3 a flowchart of an routine for deriving a intake air pressure on the basis of an intake pressure indicative signal of an intake air pressure sensor.

FIG. 3 shows a routine for deriving an intake air pressure data $P_B$ on the basis of the intake air pressure indicative signal $V_{PB}$ which is originally a voltage signal which is variable depending upon the magnitude of the intake air pressure. The shown routine of FIG. 3 is triggered and executed every 4 ms by interrupting a background job which may include a routine for governing trigger timing of various interrupt routines, some of which will be discussed later.

Immediately after starting execution of the routine of FIG. 3, the intake air pressure indicative signal $v_{PB}$ is read out at a step S1. Then, a intake air pressure map 110 which is set in ROM 103 in a form of one-dimensional map, is accessed at a step S2. At the step S2, map look-up is performed in terms of the read intake air pressure indicative signal $V_{PB}$ to derive the intake air pressure data PB. After deriving the intake pressure data PB (mmHg), the process returns to the background job.

Figure 4A:
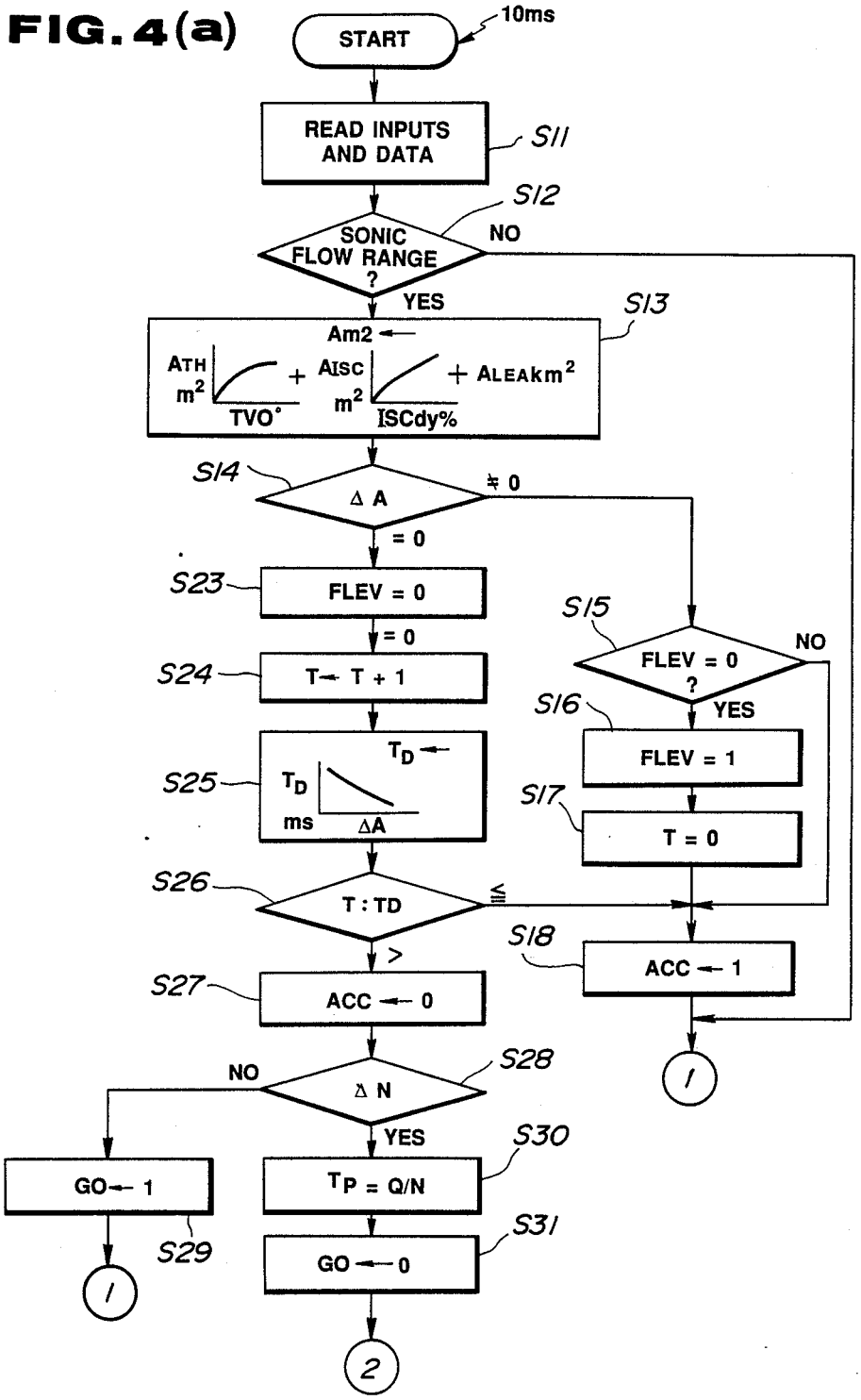
FIGS. 4(A) and 4(B) are flowcharts showing a sequence of an interrupt routine for deriving a fuel injection amount.
Figure 4B:
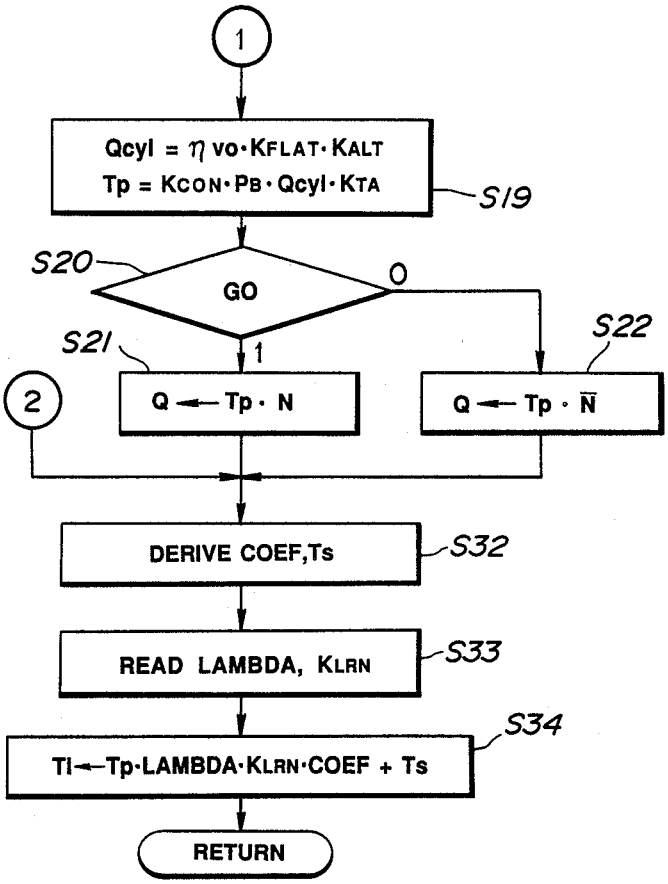

FIGS. 4(A) and 4(B) show a sequence of a routine for deriving a fuel injection amount Ti. The shown routine is triggered at every predetermined timing, e.g. every 10 ms by interrupting the background job.

Immediately after starting execution, sensor signal values and parameter data PB and engine speed data N including the intake air pressure data PB is read out at a step S11. At a step S12, the engine driving condition is checked to determine whether the engine is driven in a predetermined sonic flow range. In practice, the sonic flow range of the engine driving condition is detected by checking the intake pressure indicative data PB and by detecting the intake pressure indicative data PB representative of an intake air pressure lower than a given pressure valve, e.g. 420 mmHg.

When the intake air pressure data PB as checked at the step S12 is smaller than the given pressure value, total air flow path area A ($m^2$) is derived at a step S13. In practice, the total air flow path area A is determined by an air flow path area of a primary air passage which is variable depending upon the throttle valve angular position TVO (°), a duty cycle $ISC_{dy}$ (%), and possible intake leak amount $A_{LEAK}$ ($m^2$). The air flow area in the primary air flow path is derived by utilizinq a map which is looked up in terms of the throttle angle indicative signal value TVO. The path area in the primary air path will be hereafter referred to as "primary path area $A_{TH}$ ($m^2$)", On the other hand, the average path area in the by-pass passage or auxiliary air passage 18 is derived by utilizing a map which is looked up in terms of the duty cycle of the idling speed control signal. This path area of the auxiliary air path will be hereafter referred to as "auxiliary path area $A_{ISC}$ ($m^2$)". Therefore, the total air flow path area A can be obtained from:

$$A=A_{TH}A_{ISC}+A_{LEAK}$$

The total air flow path area A thus derived at the step S13 is compared with that derived in the immediately preceding cycle to derive a difference therebetween, at a step S14. The difference thus derived at the step S14 will be hereafter referred to as "air flow path variation indicative value ΔA". At the step S14, the air flow path variation indicative value ΔA is checked to determine whether it is zero (0) or not. When the air flow path variation indicative value ΔA is not zero as checked at the step S14, an engine load variation indicative flag FLEV which is set in a flag register 130 in CPU 101, at a step S15. If the engine load variation indicative flag FLEV is not set as checked at the step S15, the flag FLEV is set at a step S16 and a clock counter 131 resetsthe counter value T at a step S17.

When the engine load variation indicative value FLEV is set as checked at the step S15 or after the process at the step S17, a transistion state indicative flag FLTRS which is to be set in a flag register 132 in CPU 101, is set at a step S18.

Then, induction volumetric efficiency $Q_{CYL}$ is arithmetically calculated at a step S19. The induction volumetric efficiency $Q_{CYL}$ is calculated from the following equation:

$$Q_{CYL}=\eta_{vo}\times K_{FLAT}\times K_{ALT}$$

where $\eta_{vo}$ is a basic volumetric efficiency which is derived by looking up a map in terms of the intake air; pressure PB utilizing a map set in a memory block in ROM 103; $K_{FLAT}$ is a engine condition dependent volumetric efficiency correction coefficient;

$K_{ALT}$ is a altitude dependent correction coefficient.

At the step S19, a basic fuel injection amount Tp is calculated according to the following equation:

$$Tp=K_{CON}\times PB\times Q_{CYL}\times K_{TA}$$

where $K_{CON}$ is a constant;

$K_{TA}$ is a temperature dependent correction coefficient.

Figure 11:
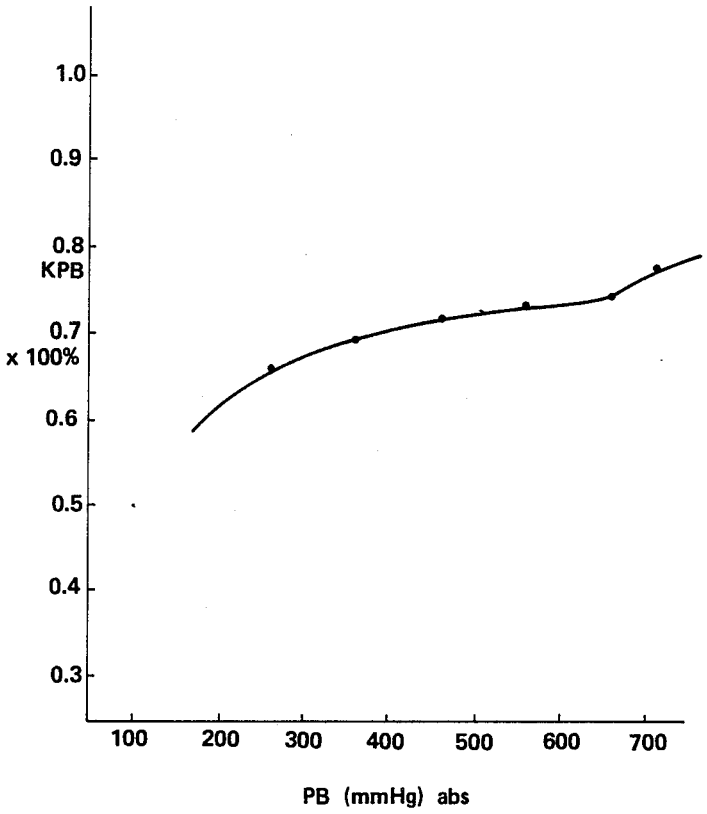
FIG. 11 is a graph showing basic induction volume efficiency versus an intake air pressure, experimentally obtained.

As will be seen from FIG. 11, the basic induction volumetric efficiency $\eta_{vo}$ is set to increase according to increasing of the intake air pressure PB. The process of derivation of the engine condition dependent volumetric efficiency correction coefficient $K_{FLAT}$ and the altitude dependent correction coefficient $K_{ALT}$ will be discussed later.

After deriving the basic fuel injection amount Tp at the step S19, an average engine speed data update indicative flag FLUP which is to be set in a flag register 133 of CPU 101, is checked at a step S20. When the average engine speed data update indicative flag FLUP is set as checked at the step S20, an intake air flow air indicative data Q is arithmetically derived from:

$$Q=Tp\times N$$

at a step S21. On the other hand, when the average engine speed data update indicative flag FLUP is reset as checked at the step S20, the intake air flow rate indicative data Q is derived from:

$$Q=Tp\times\overline{N}$$

at a step S22.

When the engine speed variation indicative value ΔA is equal to zero, the engine load variation indicative flag FLEV is reset at a step S23. Thereafter, the counter value T of the clock counter 131 is incremented by one (1) at a step S24. Then, a delay time TD is derived on the basis of the total air flow path area A utilizing a map stored in a memory block 134 of ROM 103 at a step S25. The delay time TD represents a lag time from an increasing of fuel supply amount to an increasing of the engine speed due to consumption of fuel needed to make the intake manifold wet. As will be seen from the illustration in the block of step S25, the delay time TD decreases according to an increasing of the total air flow path area A.

Though the shown embodiment derives the necessary delay time for wetting the inner periphery of the intake manifold on the basis of the total air flow area A, it may be possible to derive the delay time on the basis of the throttle valve angular position TVO.

The delay time TD derived at a step S25 is compared with the counter value T of the clock counter 131 at a step S26. When the counter value T is smaller than or equal to the delay time TD as checked at the step S26, the process goes to the step S18 set forth above. On the other hand, when the counter value T is greater than the delay time TD, the transition state indicative flag FLTRS is reset at a step S27. Thereafter, the process determines whether an engine speed difference ΔN exists within a predetermined unit period, e.g. 10 ms, at a step S28. At the step S28, the engine speed difference ΔN is compared with a predetermined engine speed difference threshold $\Delta N_{ref}$. When the engine speed difference ΔN is smaller than or equal to the engine speed difference threshold $\Delta N_{ref}$, the average engine speed update flag FLUP is set at a step S29. The process then proceeds to the step S19. On the other hand, when the engine speed difference $\Delta N$ is greater than the engine speed difference threshold $\Delta N_{ref}$, the basic fuel injection amount Tp is calculated at a step S3O on the basis of the intake air flow rate Q which is set through the step S20 or S21 at the most recent occurrence, and the engine speed data N. After processing at the step S30, the average engine speed update flag FLUP is reset at a step S31.

On the other hand, when the intake air pressure PB as checked at the step S12 is higher than the predetermined pressure, judgement is made that the engine is not within the sonic flow range. In such a case, the process directly goes to the step S19.

After one of the steps S20, S21 and S31, the process goes to a step S32. At a step S32, a correction coefficient COEF which includes an acceleration enrichment correction coefficient, a cold engine enrichment correction coefficient and so forth as components, and a battery voltage compensating correction value Ts are derived. Derivation of the correction coefficient CQEF is performed in per se well known manner which does not require further discussion. At a step S33, an air/fuel ratio dependent feedback correction coefficient $K_\lambda$ which will be hereafter referred to as "$K_\lambda$ correction coefficient", and a learning correction coefficient $K_{LRN}$ which is derived through learning process discussed later and will be hereafter referred to as "$K_{LRN}$ correction coefficient" are read out. Then, at a step S34, the fuel injection amount Ti is derived according to the following equation:

$$Ti = Tp \times K_\lambda \times K_{LRN} \times COEF + Ts$$

The control unit 11 derives a fuel injection pulse having a pulse width corresponding to the fuel injection amount Ti and sets the fuel injection pulse in the temporary register in the fuel injection signal output circuit 107.

Figure 5:
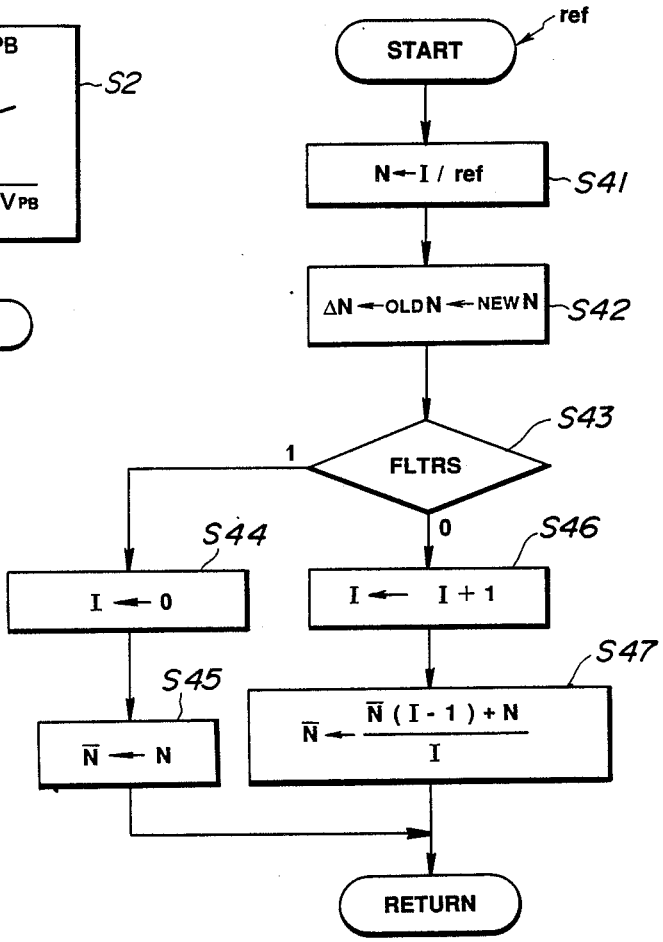
FIG. 5 is a flowchart showing an interrupt routine for deriving an engine speed data N and deriving an average engine speed $\overline{N}$.

FIG. 5 shows a routine for updating the average engine speed $\overline{N}$. The routine show in FIG. 5 is triggered every occurrence of the crank reference signal $\theta_{ref}$.

Immediately after starting execution, the engine speed data N is derived by deriving a reciprocal of an interval of occurrences of the crank reference signals $\theta_{ref}$ at a step S41. The newly derived engine speed data N is compared with the engine speed data derived in the immediately preceding cycle to obtain the engine speed difference $\Delta N$, at a step S42. Then, the transistion state indicative flag FLTRS is checked at a step S43. When the transition state indicative flag FLTRS is set as checked at the step S43, the counter value I of a sampling number counter 135 in RAM 10 is cleared at a step S44. Thereafter, the newly derived engine speed data N is set as the average engine speed indicative data $\overline{N}$ at a step S45.

On the other hand, when the transistion state indicative flag FLTRS as checked at the step S43 is not set, the sampled number counter value I of the sampling number counter 135 is incremented by one (1) at a step S46. Then, at a step S47, the average engine speed data $\overline{N}$ is derived from the following equation:

$$\overline{N} = \{\overline{N}_{old} \times (I-1\{+N_{new}\}/I$$

where $\overline{N}_{old}$ is the average engine speed data derived in the immediately preceding cycle and $N_{new}$ is the engine speed data derived in the instantaneous execution cycle.

After one of the steps S45 and S47, process goes to END to return the background job.

Figure 6A:
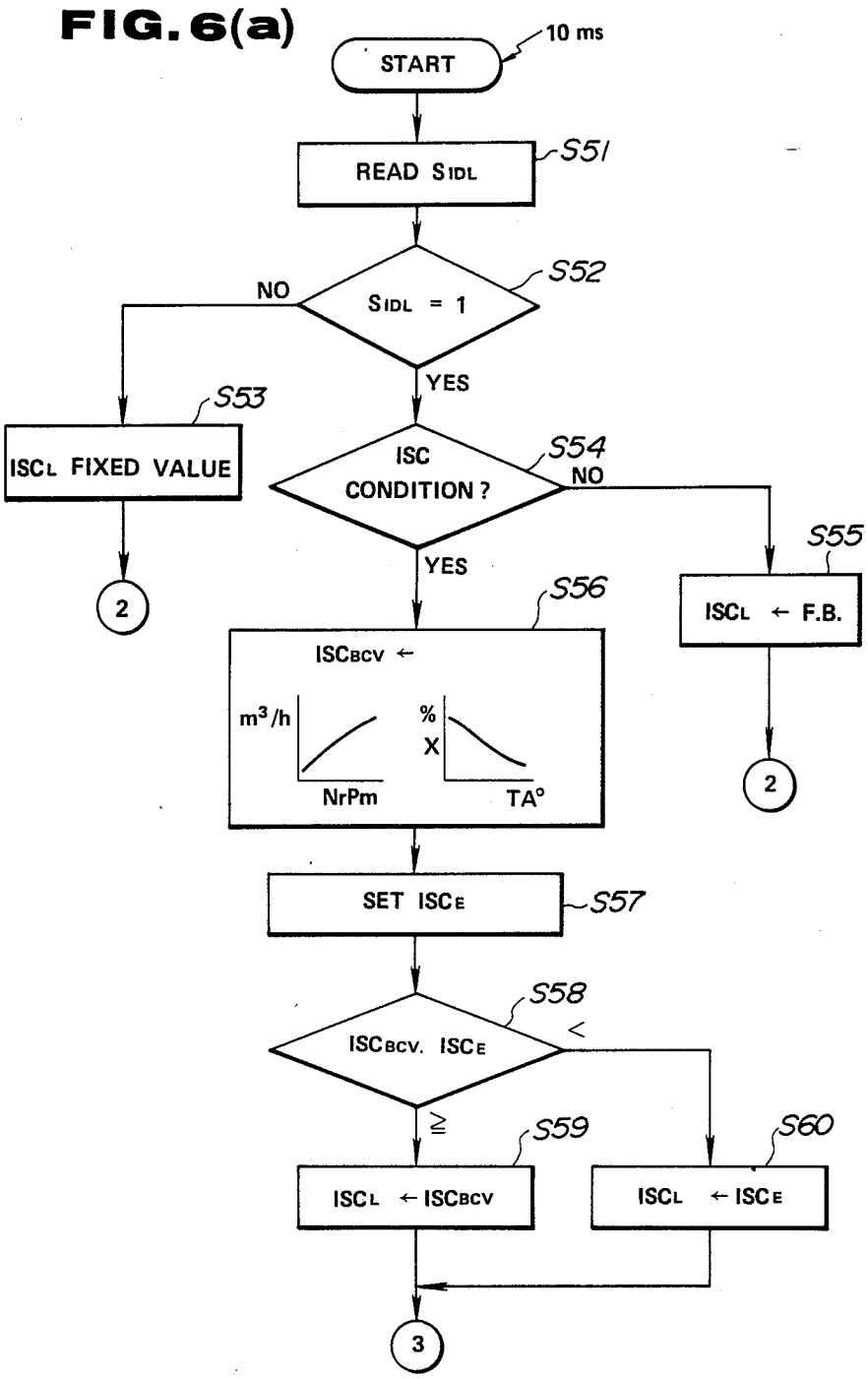
FIGS. 6(A) and 6(B) are flowcharts showing a sequence an interrupt routine for setting an engine idling controlling duty ratio and assuming an altitude for altitude dependent fuel supply amount correction
Figure 6B:
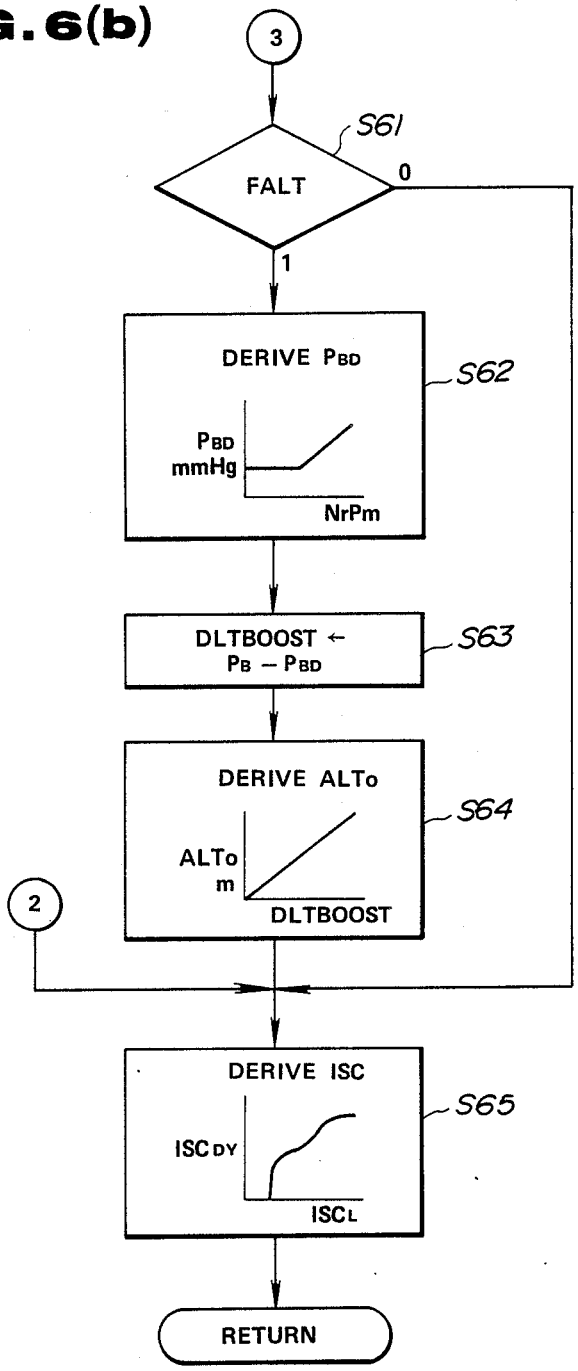

FIGS. 6(A) and 6(B) show a sequence of routine for deriving an idling speed control pulse signal and assuming altitude. The routine shown in FIGS. 6(A) and 6(B) is performed at every 10 ms. The trigger timing of this routine is shifted in phase at 5 ms relative to the routine of FIGS. 6(A) and 6(B) and therefore will not interfere to each other.

Immediately after starting execution, a signal level of the idle switch signal $S_{IDL}$ from the idle switch 8a is read at a step S51. Then, the idle switch signal level $S_{IDL}$ is checked whether it is one (1) representing the engine idling condition or not, at a step S52. When the idle switch signal level $S_{IDL}$ is zero (0) as checked at the step S52 and thus indicates that the engine is not in idling condition, an auxiliary air flow rate $ISC_L$ is set at a given fixed value which is derived on the basis of the predetermined auxiliary air control parameter, such as the engine coolant temperature Tw, at a step S53. On the other hand, when the idle switch signal level $S_{IDL}$ is one as checked at the step S52 and thus represents the engine idling condition, the engine driving condition is checked at a step S54 whether a predetermined FEEDBACK control condition which will be hereafter referred to as "ISC condition", is satisfied or not. In the embodiment, shown the engine speed data N, the vehicle speed data VSP and the HIGH level transmission neutral switch signal $N_T$ are selected as ISC condition determining parameters. Namely, ISC condition is satisfied when the engine speed data N is smaller than or equal to an idling speed criterion, the vehicle speed data VSP is smaller than a low vehicle speed criterion, e.g. 8 km/h, and the transmission neutral switch signal level is HIGH.

When ISC condition is not satisfied as checked at the step S54, the auxiliary air flow control signal $ISC_L$ is set at a feedback control value F.B. which is derived to reduce a difference between the actual engine speed and a target engine speed which is derived on the basis of the engine coolant temperature, at a step S55. On the other hand, when the ISC condition is satisfied as checked at the step S54, a boost controlling auxiliary air flow rate $ISC_{BCV}$ is set at a value determined on the basis of the engine speed indicative data N and the intake air temperature Ta for performing boost control to maintain the vacuum pressure in the intake manifold constant, at a step S56. As seen in the block of the step S56 in FIG. 6(A), the auxiliary air flow rate ($m^3/h$) is basically determined based on the engine speed indicative data N and is corrected by a correction coefficient (%) derived on the basis of the intake air temperature Ta.

At a step S57, a stable engine auxiliary air flow rate $ISC_E$ is derived at a value which can prevent the engine from falling into a stall condition and can maintain the stable engine condition. Then, the stable engine auxiliary air flow rate $ISC_E$ is compared with the boost controlling auxiliary air flow rate $ISC_{BCV}$ at a step S58. When the boost controlling auxiliary air flow rate $ISC_{BCV}$ is greater than or equal to the stable engine auxiliary air flow rate $ISC_E$, the boost controlling auxiliary air flow rate $ISC_{BVC}$ is set as the auxiliary air control signal value $ISC_L$, at a step S59. On the other hand, when the stable engine auxiliary air flow rate $ISC_E$ is greater than the boost controlling auxiliary air flow rate $ISC_{BCV}$, the auxiliary air control signal value $ISC_L$ is set at the value of the stable engine auxiliary air flow rate $ISC_E$ at a step S60.

After one of the steps S59 and S60, the FALT flag is checked at a step S61. When the FALT flag is set as checked at the step S61, an intake air pressure $P_{BD}$ during deceleration versus the engine speed indicative data N is derived at a step S62, which intake air pressure will be hereafter referred to as "decelerating intake air pressure". In practice, the decelerating intake air pressure $P_{BD}$ is set in a one-dimensional map stored in a memory block 117 in ROM 103. The $P_{BD}$ map is looked up in terms of the engine speed indicative data N. Then, a difference of the intake air pressure $P_B$ and the decelerating intake air pressure $P_{BD}$ is derived at a step S63, which difference will be hereafter referred to as "pressure difference data ABOOST". Utilizing the pressure difference data ΔBOOST derived at the step S63, an assumed altitude data $ALT_0$ (m) is derived. The assumed altitude data $ALT_0$ is set in a form of a map set in a memory block 18 so as to be looked up in terms of the pressure difference data ΔBOOST.

After one of the steps S53, S55 and S64 or when the FALT flag is not set as checked at the step S61, an auxiliary air control pulse width ISCDY which defines the duty ratio of OPEN periods and CLOSE periods of the auxiliary air control valve 19, is derived on the basis of the auxiliary air control signal value at a step S65.

Figure 7:
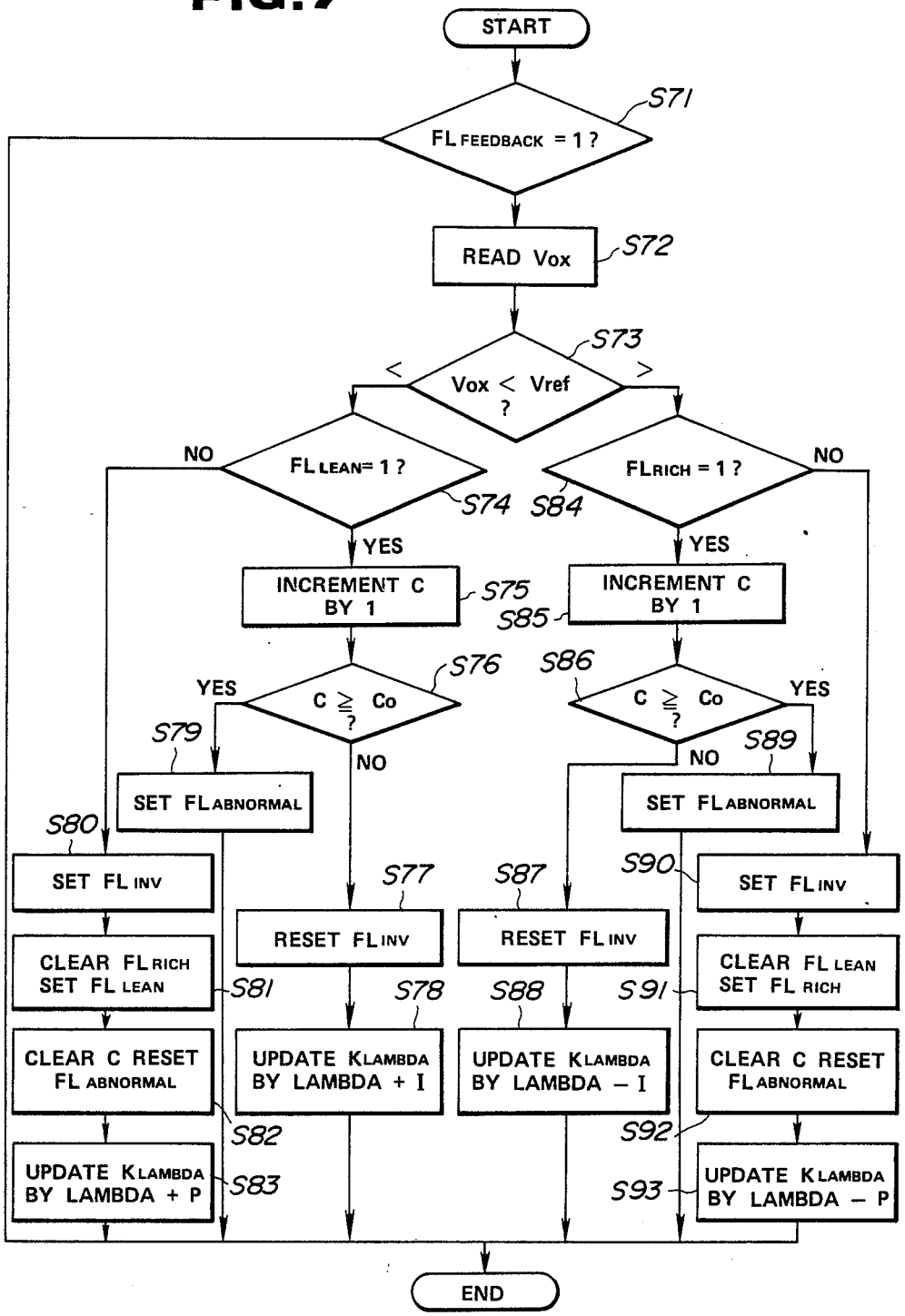
FIG. 7 is a flow chart of an interrupt routine for deriving an air/fuel ratio feedback controlling correction coefficient on the basis of an oxygen concentration in an exhaust gas.

FIG. 7 shows a routine for deriving the feedback correction coefficient $K_\lambda$. The feedback correction coefficient $K_\lambda$ is composed of a proportional (P) component and an integral (I) component. The shown routine is triggered every given timing in order to regularly update the feedback control coefficient $K_\lambda$. In the shown embodiment, shown the trigger timing of the shown routine is determined in synchronism with the engine revolution cycle. The feedback control coefficient $K_\lambda$ is stored in a memory block 118 and cyclically updated during a period in which FEEDBACK control is performed.

At a step S71, the engine driving condition is checked to determine whether it satisfies a predetermined condition for performing air/fuel ratio dependent feedback control of fuel supply. In practice, a routine (not shown) for governing the control mode to switch the mode between FEEDBACK control mode and OPEN LOOP control mode based on the engine driving condition is performed. Basically, FEEDBACK control of air/fuel ratio is taken place while the engine is driven under load low and at low speed and OPEN LOOP control is performed otherwise. In order to selectively perform FEEDBACK control and OPEN LOOP control, the basic fuel injection amount Tp is taken as a parameter for detecting the engine driving condition. For distinguishing the engine driving condition, a map containing FEEDBACK condition indicative criteria $Tp_{ref}$ is set in an appropriate memory block of ROM. The map is designed to be searched in terms of the engine speed N. The FEEDBACK condition indicative criteria set in the map are experimentally obtained and define the engine driving range to perform FEEDBACK control The basic fuel injection amount Tp derived is then compared with the FEEDBACK condition indicative criterion $Tp_{ref}$). When the basic fuel injection amount Tp is smaller than or equal to the FEEDBACK condition indicative criterion $Tp_{ref}$ a delay timer in the control unit and connected to a clock generator is reset to clear a delay timer value. On the other hand, when the basic fuel injection amount Tp is greater than the FEEDBACK condition indicative criterion $Tp_{ref}$ the delay timer value $t_{DELAY}$ is read and compared with a timer reference value $t_{ref}$. If the delay timer value $t_{DELAY}$ is smaller than or equal to the timer reference value $t_{ref}$, the engine speed data N is read and compared with an engine speed reference $N_{ref}$. The engine speed reference $N_{ref}$ represents the engine speed criterion between high engine speed range and low engine speed range. Practically, the engine speed reference $N_{ref}$ is set at a value corresponding to a high/low engine speed criteria, e.g. 3800 r.p.m. When the engine speed indicative data N is smaller than the engine speed reference $N_{ref}$, a FEEDBACK condition indicative flag $FL_{FEEDBACK}$ which is to be set in a flag register 119 in the control unit 100, is set. When the delay timer value $t_{DELAY}$ is greater than the timer reference value $t_{ref}$, a FEEDBACK condition indicative flag $FL_{FEEDBACK}$ is reset.

By providing the delay timer which switch the mode of control between FEEDBACK control and OPEN LOOP control, hunting in selection of the control mode can be successfully prevented. Furthermore, by providing the delay timer for delaying switching timing of control mode from FEEDBACK control to OPEN LOOP mode, FEEDBACK control can be maintained for the period of time corresponding to the period defined by the timer reference value. This expands period to perform FEEDBACK control and to perform learning.

Therefore, at the step S71, a FEEDBACK condition indicative flag $FL_{FEEDBACK}$ is checked. When the FEEDBACK condition indicative flag $FL_{FEEDBACK}$ is not set as checked at the step S71, the on-going control mode is OPEN LOOP. Therefore, the process directly goes END. At this point, since the feedback correction coefficient $K_\lambda$ is not updated, the content in the memory block 118 storing the feedback correction coefficient is unchanged.

When the FEEDBACK condition indicative flag $FL_{FEEDBACK}$ is set as checked at a step S71, the oxygen c concentration indicative signal $O_2$ from the oxygen sensor 14 is read out at a step S72. The oxygen concentration indicative signal value $O_2$ is then compared with a predetermined rich/lean criterion $V_{ref}$ which corresponding to the air/fuel ratio of stoichiometric value, at a step S73. In practice, in the process, judgment is made that the air/fuel mixture is lean when the oxygen concentration indicative signal value $O_2$ is smaller than the rich/lean criterion $V_{ref}$, a lean mixture indicative flag $FL_{LEAN}$ which is set in a lean mixture indicative flag register 120 in the control unit 100, is checked at a step S74.

On the other hand, when the lean mixture indicative flag $FL_{LEAN}$ is set as checked at the step S74, a counter value C of a faulty sensor detecting timer 121 in the control unit 100 is incremented by one (1), at a step S75. The counter value C will be hereafter referred to as "faulty timer value". The, faulty timer value C is compared with a preset faulty timer criterion $C_0$ which represents an acceptable maximum period of time to maintain lean mixture indicative $O_2$ sensor signal while the oxygen sensor 20 operates in a normal state, at a step S76. When the faulty timer value C is smaller than the faulty timer criterion $C_0$, the rich/lean inversion indicative flag $FL_{INV}$ is reset at a step S77. Thereafter, the feedback correction coefficient $K_\lambda$ is updated by adding a given integral constant (I constant), at a step S78. On the other hand, when the faulty timer value C as checked at the step S76 is greater than or equal to the faulty timer criterion $C_0$, a faulty sensor indicative flag $FL_{ABNORMAL}$ is set in a flag register 123 at a step S79. After setting the faulty sensor indicative flag $FL_{ABNORMAL}$, the process goes to END.

On the other hand, when the lean mixture indicative flag $FL_{LEAN}$ is not set as checked at the step S74, which represents that the fact that the air/fuel mixture ratio is changed from rich to lean, a rich/lean inversion indicative flag $FL_{INV}$ which is set in a flag register 122 in the control unit 100, is set at a step S80. Thereafter, a rich mixture indicative flag $FL_{RICH}$ which is set in a flag register 124, is reset and the lean mixture indicative flag $FL_{LEAN}$ is set, at a step S81. Thereafter, the faulty timer value C in the faulty sensor detecting timer 121 is reset and the faulty sensor indicative flag $FL_{ABNORMAL}$ is reset, at a step S82. Then, the feedback correction coefficient $K_\lambda$ is modified by adding a proportional constant (P constant), at a step S83.

On the other hand, when the oxygen concentration indicative signal value $O_2$ is greater than the rich/lean criterion $V_{ref}$ as checked at the step S73, a rich mixture indicative flag $FL_{RICH}$ which is set in a rich mixture indicative flag register 124 in the control unit 100, is checked at a step S84.

When the rich mixture indicative flag $FL_{RICH}$ is set as checked at the step S84, the counter value C of the faulty sensor detecting timer 121 in the control unit 100 is incremented by one (1), at a step S85. The faulty timer value C is compared with the preset faulty timer criterion $C_0$ at a step S86. When the faulty timer value C is smaller than the faulty timer criterion $C_0$, the rich/lean inversion indicative flag $FL_{INV}$ is reset at a step S87. Thereafter, the feedback correction coefficient $K_\lambda$ is updated by subtracting the I constant, at a step S88.

On the other hand, when the faulty timer value C as checked at the step S86 is greater than or equal to the faulty timer criterion $C_0$, a faulty sensor indicative flag $FL_{ABNORMAL}$ is set at a step S89. After setting the faulty sensor indicative flag $FL_{ABNORMAL}$, the process goes to END.

When the rich mixture indicative flag $FL_{RICH}$ is not set as checked at the step S84, which represents the fact that the air/fuel mixture ratio is just changed from lean to rich, a rich/lean inversion indicative flag $FL_{INV}$ which is set in a flag register 122 in the control unit 100, is set at a step S90. Thereafter, a rich mixture indicative flag $FL_{LEAN}$ is reset and the rich mixture indicative flag $FL_{RICH}$ is set, at a step S91. Thereafter, the faulty timer value C in the faulty sensor detecting timer 121 is reset and the faulty sensor indicative flag $FL_{ABNORMAL}$ is reset at a step S92. Then, the feedback correction coefficient $K_\lambda$ is modified by subtracting the P constant at a step S93.

After one of the process of the steps S78, S79, S83, S88, S89 and S93, the process goes to the END.

It should be noted that, in the shown embodiment, the P component is set at a value far greater than that of I component.

Figure 8A:
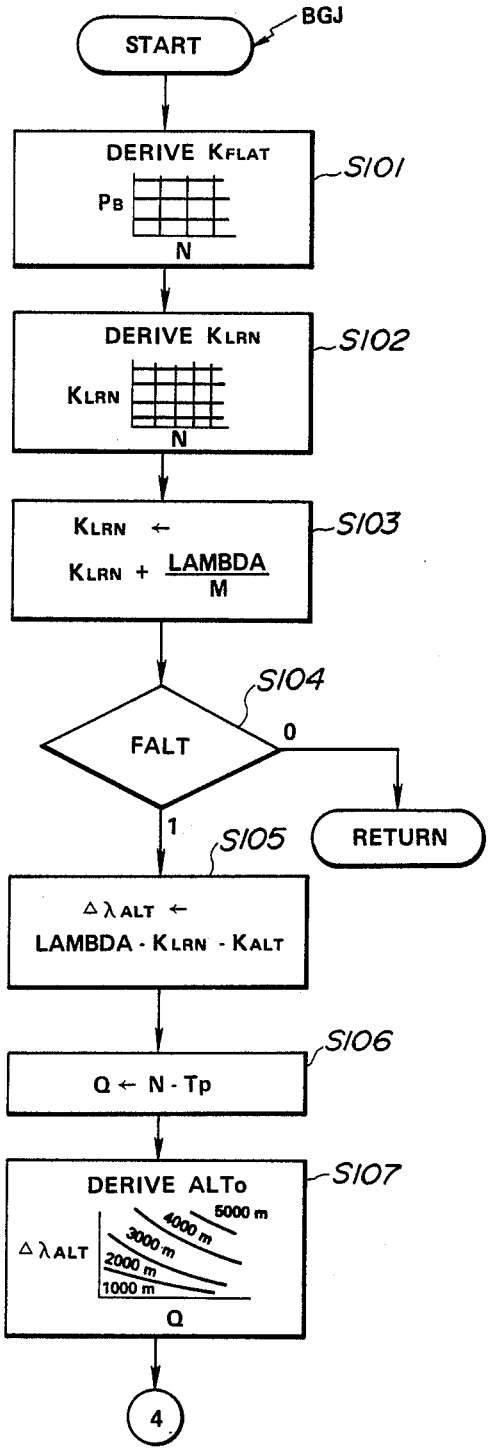
FIGS. 8(A) and 8(B) are flowcharts showing a sequence of background job executed by the control unit of FIG. 2.
Figure 8B:
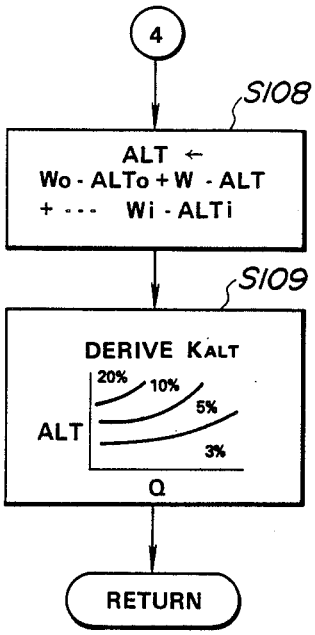

FIGS. 8(A) and 8(B) show a sequence of a routine composed as a part of the main program to be executed by the control unit 11 as the background job. The shown routine is designed to derive the $K_{FLAT}$ correction coefficient, the $K_{LRN}$ correction coefficient and the altitude dependent correction coefficient, and to derive the assumed altitude.

At a step S101 which is triggered immediately after starting the shown routine, the $K_{FLAT}$ correction coefficient is derived in terms of the engine speed data N and the intake air pressure data PB for correcting the basic induction volumetric efficiency $\eta_{vo}$. In practice, the $K_{FLAT}$ correction coefficients are set in a form of two-dimensional look-up table in a memory block 125 of ROM 102. Therefore, the $K_{FLAT}$ correction coefficient is derived through map look up in terms of the engine speed data N and the intake air pressure data PB.

It will be appreciated that magnitude of variation of the induction volumetric efficiency in relation to variation of the engine speed is relatively small. Therefore, the $K_{FLAT}$ correction coefficient can be set as a function of the intake air pressure PB. In this case, since the variation range of the $K_{FLAT}$ correction coefficient can be concentrated in the vicinity of one (1). Therefore, the number of grids for storing the correction coefficient values for deriving the $K_{FLAT}$ correction coefficient in terms of the engine speed and the intake air pressure can be small. In addition, since delay of updating of the $K_{FLAT}$ correction coefficient cannot cause substantial error, the interval of updating of the $K_{FLAT}$ correction coefficient can be set long enough to perform in the background job. Although the updating interval is relatively long, accuracy in derivation of the induction volumetric efficiency can be substantially improved in comparison with the manner of derivation described in the aforementioned Tokkai Showa 58-41230, in which the correction coefficient is derived solely in terms of the engine speed, since the $K_{FLAT}$ correction coefficient derived in the shown routine is variable depending on not only the engine speed data N but also the intake air pressure PB.

At a step S102, the $K_{LRN}$ correction coefficient is derived on the basis of the engine speed data N and the basic fuel injection amount Tp. In order to enable this, $K_{LRN}$ correction coefficients are set in a form of a two-dimensional look-up map in a memory address 126 in RAM 103. The $K_{LRN}$ correction coefficient derived at the step S1O2 is modified by adding a given value derived as a function of an average value of the $K_\lambda$ correction coefficient for updating the content in the address of the memory block 126 corresponding to the instantaneous engine driving range at a step S103. In practice, updating value $K_{LRN(new)}$ of the $K_{LRN}$ correction coefficient is derived by the following equation:

$$K_{LRN(new)} = K_{LRN} + K_\lambda / M$$

where M is a given constant value.

Thereafter, the FALT flag is checked at a step S104. When the FALT flag is not set, the process goes to END. On the other hand, when the FALT flag is set as checked at the step S104, an error value $\Delta\lambda_{ALT}$ which represents an error from a reference air/fuel ratio ($\lambda=1$) due to altitude variation, calculated at a step S105. In the process done in the step S105, the error value $\Delta\lambda_{ALT}$ is produced by multiplying the average value $\overline{K}_\lambda$ by the modified $K_{LRN}$ correction coefficient $K_{LRN(new)}$ and the $K_{ALT}$ correction coefficient.

At a step S106, an intake air flow rate data Q is derived by multiplying the basic fuel injection amount Tp by the engine speed data N. Then, based on the error value $\Delta\lambda_{ALT}$ derived at the step S105 and the intake air flow rate data Q derived at the step S106, an altitude indicative data $ALT_0$ is derived from a two-dimensional map stored in a memory block 127 of RAM 103.

Here, as will be appreciated, the error value $\Delta\lambda_{ALT}$ is increased according to increasing altitude which cause a decreasing of air density. On the other hand, the error value $\Delta\lambda_{ALT}$ decreases according to an increasing of the intake air flow rate Q. Therefore, the variation of the altitude significantly influence the error value $\Delta\lambda_{ALT}$. Therefore, in practice, the assumed altitude $ALT_0$ to be derived in the step S107 increases according to decreasing intake air flow rate Q and according to an increasing of the error value $\Delta\lambda_{ALT}$.

The assumed altitude data $ALT_0$ is stored in a shift register 128.

Figure 9:
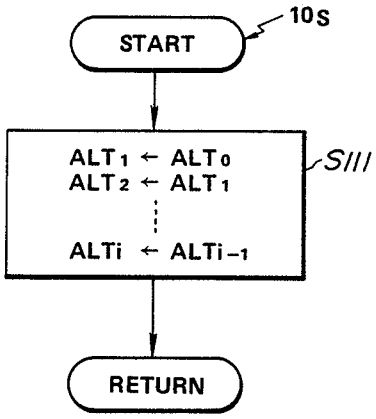
FIG. 9 is a flowchart of a routine for deriving an average assumed altitude.
Figure 10:
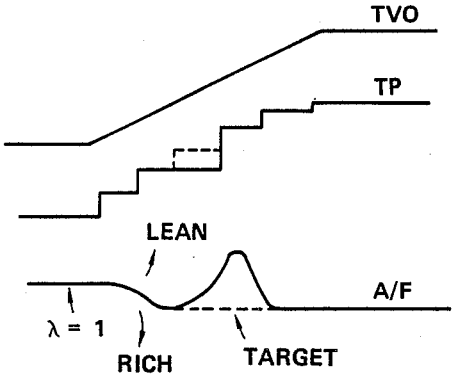
FIG. 10 is a chart showing the relationship between an air/fuel ratio, basic fuel injection amount Tp and a throttle valve angle.

At a step S108, an average value $\overline{ALT}$ of the assumed altitude $ALT_0$ is derived over a given number (i) of precedingly derived assumed altitude data $ALT_0$. For enabling this, the interrupt routine of FIG. 9 is performed at every given timing, e.g. every 10 sec. In the routine of FIG. 9, sorting of the stored assumed altitude data ALT is performed at a step S111. Namely, the shift register 128 is operated to sort the assumed altitude data ALT in the order of derivation timing. Namely, most recent data is set as $ALT_1$ and the oldest data is set as $ALt_i$.

At the step S108, the average altitude data $\overline{ALT}$ is derived by the following equation:

$$\overline{ALT}=W_0\times ALT_0+W_1\times ALT_1 \ldots W_i\times ALT_i$$

where $W_0, W_1 \ldots W_i$ are constant ($W_0>W_1>\ldots>W_i$; $W_0+W_1\ldots W_i=1$)

Utilizing the intake air flow rate data Q derived at the step S106 and the average altitude data $\overline{ALT}$ derived at the step S108, the $K_{ALT}$ correction coefficient is derived, at a step S109. In the process of the step S109, map look-up against a two-dimensional map set in a memory block 129 in ROM 102 is performed in terms of the intake flow rate Q and the average altitude data $\overline{ALT}$.

Here, it will be noted that when the altitude is increased decreasing of the atmospheric pressure reduces resistance for exhaust gas. Therefore, at higher altitudes, induction volumetric efficiency is increased even at the same intake air pressure to that in the lower altitudes. By this, the air/fuel mixture to be introduced into the engine cylinder becomes leaner. On the other hand, the exhaust pressure becomes smaller as decreasing the intake air flow rate and thus subject greater influence of variation of the atmospheric pressure. Therefore, the $K_{ALT}$ correction coefficient is set to be increased at higher rate as increasing of the average altitude data $\overline{ALT}$ and at decreasing the intake air flow rate Q.

In summary, a fuel injection amount in L-Jetronics type fuel injection is derived on the basis of the engine speed N and the intake air flow rate Q. As is well known, the basic fuel injection amount is derived by:

$$tp=K_{CONL}\times Q/N$$

where $K_{CONL}$=F/A (F/I gradient)×1/60 ×(number of cylinder)

F/A: reciprocal of air/fuel ratio

F/I gradient (ms/kg) =1/(fuel flow rate per injection (l)×$\rho$ $\rho$: specific gravity of fuel Here, the intake air flow rate Q can be illustrated by:

$$Q=n=PV/RT=(Pn\times V_0\times\eta_v\times N)/2R_m\times Tm$$

where

Pn=P $V=\frac{1}{2}V_0\times\eta_n\times N$ $\eta_v$ volumetric efficiency

R=Rm (=29.27)

T=Tm

PV=nRT K M (equation of state of gas)

$V^0$: total exhaust gas amount $M^3$

Tm: absolute temperature of intake air T;

n: intake air weight K

R: constant of gas M $T^{-1}$:

From the above equation, the equation for deriving Tp can be modified to:

$$Tp=K_{CONL}\times\{(N\times 60\times V_0)/(2\,Rm\times Tm_{ref})\times Pn\times\eta_v\times K_{TA}\}/N$$

where $1/Tm=K_{TA/Tmref}$ $Tm_{ref}$ is a reference temperature, e.g. 30° C.

$K_{TA}$ is an intake air temperature dependent correction coefficient which becomes 1 when the intake air temperature is equal to a reference temperature and increases according to a lowering of the intake air temperature below the reference temperature and decreases according to rising of the intake air temperature above the reference temperature. Here, assuming $$K_{COND}=K_{CONL}\times(60\times V_0)/(2\,Rm\times 303°\,K)$$

the equation for deriving Tp can be modified as follows:

According to the present invention, since the altitude can be assumed based on the $K_{LRN}$ correction coefficient during hill-climbing and based on the pressure difference between the set intake air pressure and actual intake air pressure during down-hill driving, altitude can be assumed at any vehicular driving condition with sufficient precision. With satisfactorily high precision of the assumed altitude, the $K_{ALT}$ correction value can be precise enough to precise it set the induction volumetric efficiency.

Furthermore, since the shown embodiment of the fuel supply control system derives the basic fuel injection amount by multiplying the intake air pressure PB by the induction $$K_{COND}=K_{CONL}\times(60\times V_0)/(2\,Rm\times 303°\,K)$$

$$\eta_v = \text{(intake air volume)/(cylinder volume)} = K_{PB}\times K_{FLAT}\times K_{ALT}$$

$$K_{ALT} = \text{(intake air volume)/(reference intake air volume)} = (Vro-Vr')/(Vro-Vr'_{ref}) = \{Vro\times(1-Vr'/Vro)\}/\{Vro\times(1-Vr'_{ref}/Vro)\}$$

where

Vro is BDC (bottom dead center) cylinder volume;

Vr' is BDC remained exhaust gas volume; and $Vr'_{ref}$ is standard remained exhaust gas volume $$=\{1-1/E\times(Vr'/Vr)\}/\{1-1/E\times(Vr'_{ref}/Vr)\}$$

Vr is TDC (top dead center) cylinder volume $$Vr = 1/E \times Vro$$
$$= \{1 - 1/E \times (Pr/PB)\}/\{1 - 1/E \times (Pr_{ref}/PB)\}$$

$$Vr'/Vr=(Pr/PB)^{1/K}$$

E: compression ratio;
K: relative temperature;
Pr: exhaust gas pressure (abs)

As will be appreciated herefrom, by employing the $K_{ALT}$ correction coefficient, error in λ control, altitude dependent error versus of the intake air pressure in deceleration or in acceleration at a certain altitude versus that in the standard altitude, can be satisfactorily compensated without requiring an exhaust pressure sensor and atmospheric pressure sensor.

According to the present invention, since the altitude can be assumed based on the $K_{LRN}$ correction coefficient during hill-climbing and based on the pressure difference between the set intake air pressure and actual intake air pressure during down-hill driving, altitude can be assumed at any vehicular driving condition with sufficient precision. With satisfactorily high precision of the assumed altitude, the $K_{ALT}$ correction value can be precise enough to precise it set the induction volumetric efficiency.

Furthermore, since the shown embodiment of the fuel supply control system derives the basic fuel injection amount by multiplying the intake air pressure PB by the induction volumetric efficiency $Q_{CYL}$, modifying the product with intake air temperature dependent correction coefficient $K_{TA}$, and multiplying the modified product by the constant $K_{CON}$, the resultant value as the basic fuel injection amount can be satisfactorily precise.

Furthermore and more importantly, the shown embodiment can assure precise control of fuel supply amount even at the low engine speed range by avoiding the influence of fluctuations of the engine speed. Therefore, the engine can be driven at satisfactory stable condition by maintaining the air/fuel ratio at stable condition.

It should be appreciate that the invention is applicable to not only the specific construction of the fuel injection control systems but also for any other constructions of the fuel injection systems. For example, the invention may be applicable for the control systems set out in the co-pending U.S. Pat. applications Ser. Nos. 171,022 and 197,843, respectively filed on Mar. 18, 1988 and May 24, 1988, which have been assigned to the common assignee to the present invention. The disclosure of the above-identified two U.S. Pat. applications are herein incorporated by reference for the sake of disclosure.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention in the appended claims.

What is claimed is:

1. A fuel supply control system for controlling an amount of fuel to be delivered to an internal combustion engine, comprising:
   - a sensor means for monitoring preselected engine driving condition indicative parameters including an intake air pressure and an engine speed;
   - a first detector means for detecting a predetermined stable engine driving condition at an engine load condition lower than a predetermined value to produce a first detector signal;
   - a second detector means for detecting an engine speed variation rate to produce a second detector signal when the engine speed variation rate is smaller than a predetermined value;
   - a first arithmetic means for deriving a basic fuel supply amount on the basis of said intake air pressure;
   - a second arithmetic means for projecting an intake air flow rate data on the basis of said engine speed and said basic fuel supply amount under the presence of said first and second detector signals;
   - a third arithmetic means for deriving said basic fuel supply amount on the basis of said engine speed and said projected intake air flow rate data under the presence of said first detector signal and the absence of said second detector signal, said first arithmetic means being otherwise operable to derive said basic fuel supply amount; and
   - a controlling means for deriving a fuel supply control signal based on said basic fuel supply amount for controlling fuel supply for said engine.

2. A fuel supply control system as set forth in claim 1, which further comprises a fourth arithmetic means for deriving an engine speed data on the basis of the monitored engine speed, said fourth arithmetic means operating in a first mode for updating said engine speed data with an instantaneous engine speed and in a second mode for updating said engine speed data with an average value which is derived from a dynamic average value of previously derived engine speed data and the instantaneous engine speed, said fourth arithmeic means operating in said first mode in response to said first detector signal.

3. A fuel supply control system as set forth in claim 1, wherein said first detector means detects said intake air pressure lower than or equal to a predetermined pressure and an intake air flow path area variation rate smaller than a given air flow path variation threshold.

4. A fuel supply control system as set forth in claim 3, wherein said first detector means produces said first signal when said predetermined air flow rate variation is zero.

5. A fuel supply control system as set forth in claim 1, wherein said predetermined value of said engine speed variation rate is zero.

6. A fuel supply control system as set forth in claim 1, which further comprises a timer means responsive to the leading edge of said first detector signal for measuring an elapsed period of time to produce a timer signal when the measured period reaches a given period, and wherein said third arithmetic means is responsive to said timer signal under an absence of said second detector signal to derive said basic fuel supply amount.

7. A fuel supply control system for an internal combustion engine comprising:

first means for supplying a controlled amount of fuel to an induction system of said internal combustion engine;

second means for monitoring an engine driving condition including an engine speed and an intake air pressure;

third means for detecting a predetermined low engine load condition to produce a detector signal;

fourth means for deriving an engine driving stability factor indicative value on the basis of preselected engine driving stability parameters;

fifth means for deriving a first basic fuel supply amount on the basis of said intake air pressure;

sixth means for projecting an intake air flow rate data on the basis of said first basic fuel supply amount and said engine speed;

seventh means for deriving a second basic fuel supply amount on the basis of said engine speed and said projected intake air flow rate;

eighth means for selectively operating one of said fifth and seventh means, said eighth means being responsive to said detector signal and said engine driving stability factor indicative value smaller than a predetermined value for operating said fifth means and otherwise operating said seventh means; and ninth means for producing a fuel supply control signal on the basis of one of said first and second basic fuel supply amounts for controlling operation of said first means.

8. A fuel supply control system as set forth in claim 7, wherein said fifth means derives a basic volumetric efficiency on the basis of said intake air pressure and derives said first basic fuel supply amount on the basis of said intake air pressure and said basic volumetric efficiency.

9. A fuel supply control system as set forth in claim 7, wherein said second means additionally monitors a throttle angular position, and said fourth means derives an intake air flow path area and variation rate of the intake air flow path area as a transistion representative first stability factor data on the basis of said throttle angular position.

10. A fuel supply control system as set forth in claim 9, wherein said fourth means further derives an engine speed variation rate as a second stability factor data, and said eighth means operates said fifth means when said engine speed variation rate is smaller than a predetermined value.

11. A fuel supply control system as set forth in claim 9, which further comprises tenth means for deriving an average engine speed, wherein data said eighth means controls operation of said tenth means for setting instantaneous engine speed as said average engine speed data when said air flow path area variation rate is greater than a predetermined value and for deriving said average engine speed data on the basis of said derived in the immediately preceding operation cycle when said air flow path area variation rate is smaller than or equal to said predetermined value.

12. A fuel supply control system as set forth in claim 11, wherein said second means further monitors an engine idling speed control parameter, said system further comprises an eleventh means for deriving an engine idling control signal, and said fourth means derives said air flow path area variation rate on the basis of said throttle valve angular position and said engine idling control signal value.

13. A fuel supply control system as set forth in claim 7, wherein said predetermined low engine load condition comprises a sonic flow range.

* * * * *